United States Patent [19]

Cook

[11] Patent Number: 5,054,455

[45] Date of Patent: Oct. 8, 1991

[54] REGULATED FLOW CANISTER PURGE SYSTEM

[75] Inventor: John E. Cook, Chatham, Canada

[73] Assignee: Siemens-Bendix Automotive Electronics Limited, Chatham, Canada

[21] Appl. No.: 490,791

[22] Filed: Mar. 8, 1990

Related U.S. Application Data

[63] Continuation-in-part of Ser. No. 452,664, Dec. 18, 1989, Pat. No. 4,995,369.

[51] Int. Cl.[5] ..... F02M 33/02

[52] U.S. Cl. ..... 123/520; 251/84; 123/516

[58] Field of Search ..... 137/907; 251/61.4, 61.5, 251/30.01; 123/516, 518, 519, 520, 521, 458; 92/99, 100, 84

[56] References Cited

U.S. PATENT DOCUMENTS

| | | | |
|---|---|---|---|
| 2,028,815 | 12/1936 | Wood | 251/84 |
| 3,800,817 | 4/1974 | Gropp et al. | 251/84 |
| 4,421,294 | 12/1983 | Parkison et al. | 251/86 |
| 4,475,711 | 10/1984 | Rountry | 251/86 |
| 4,530,210 | 7/1985 | Yamazaki | 123/520 |
| 4,647,011 | 3/1987 | Contzen | 251/86 |
| 4,887,578 | 12/1989 | Woodcock et al. | 123/516 |
| 4,944,276 | 7/1990 | House et al. | 123/520 |
| 4,953,514 | 9/1990 | Beicht et al. | 123/521 |

FOREIGN PATENT DOCUMENTS

| | | | |
|---|---|---|---|
| 0040243 | 3/1980 | Japan | 123/520 |
| 0004856 | 1/1986 | Japan | 123/518 |

*Primary Examiner*—Carl Stuart Miller
*Assistant Examiner*—Erick Solis
*Attorney, Agent, or Firm*—George L. Boller; Russel C. Wells

[57] ABSTRACT

The evaporative emission control system for an internal combustion engine purges the vapor collection canister to the throttle body through both a purge regulator controlled by the engine ECU and a variable orifice valve that is mechanically operated by the throttle mechanism. A throttle position sensor that supplies a throttle position signal to the ECU can be read by the ECU as also representing the degree of restriction being imposed by the variable orifice on the flow of vapor from the canister to the throttle body and the ECU can take this into account when setting the purge regulator. A novel construction for the purge regulator, particularly the connection between the actuator and the valve, precludes the transmission of any significant bending moment from the movable wall of the actuator to the valve. The head of the valve is designed to also contribute to improved operation.

10 Claims, 4 Drawing Sheets

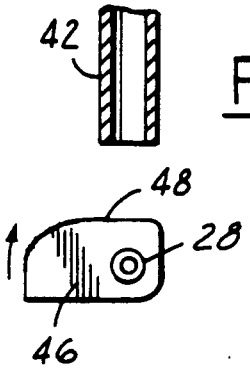
FIG.2
FIG.3
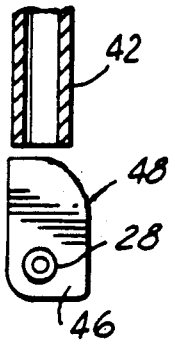
FIG.4
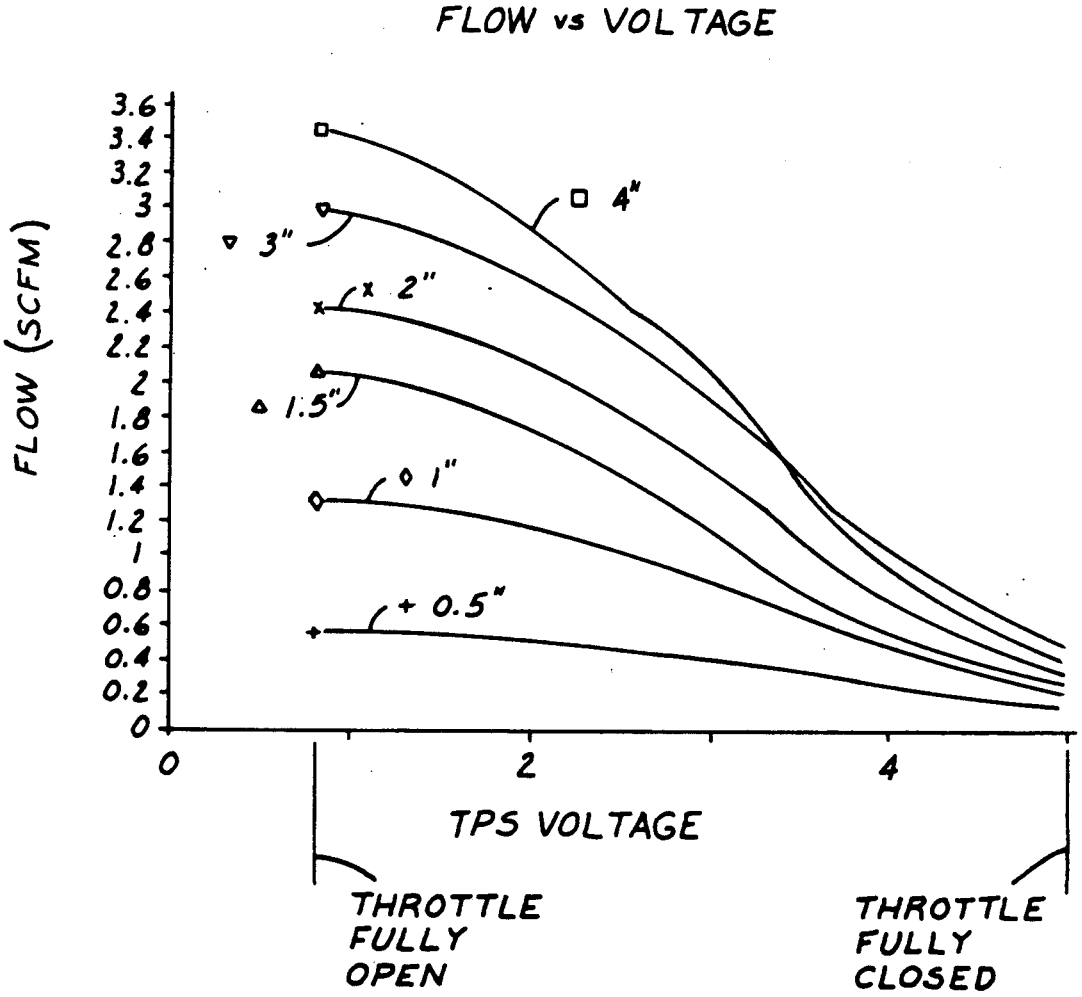

REGULATED FLOW CANISTER PURGE SYSTEM

REFERENCE TO A RELATED APPLICATION

This application is a continuation-in-part of Ser. No. 07/452,664, filed Dec. 18, 1989, now U.S. Pat. No. 4,995,369.

BACKGROUND AND SUMMARY OF THE INVENTION

This invention relates to evaporative emission control systems of the type that are commonly used in association with internal combustion engines of automotive vehicles.

In such an evaporative emission control system, excess fuel vapors from the fuel tank are collected in a canister which must be periodically purged to the engine's induction system so that the vapors can pass into the engine's cylinders for combustion. In this way, the excess vapors do not escape to atmosphere where they may otherwise contribute to air pollution. The periodic purging of the vapor collection canister is conducted when conditions conducive to purging exist, and therefore it is a customary practice to have a canister purge solenoid (CPS) valve exercise control over the venting of the canister to the induction system and to place the CPS under the control of the engine electronic control unit (ECU). Because the ECU receives signals representing various engine operating parameters, it can be programmed to allow purging of the canister at different rates depending upon the prevailing engine operating conditions. Thus at certain times, greater amounts of purging may be permitted while at others, lesser amounts may be allowed.

Governmental regulations establish limits for the amount of fuel vapor that is permitted to be emitted from an automotive vehicle to atmosphere. The establishment of stricter regulations may impose heavier burdens on evaporative emission control systems such that the present systems may not be able to achieve compliance. Accordingly, there is a need for further improvement in the existing evaporative emission control systems of automotive vehicles so that increased flow rates of excess fuel vapors can be successfully handled. The present invention is directed to a solution for meeting this need.

The first four drawing figures relate to an embodiment which comprises the inclusion of a variable orifice in the vapor flow path from the canister to the induction system and the use of the engine's throttle to exercise control over the degree of restriction imposed by the variable orifice on the vapor flow path to the induction system. The variable orifice is progressively increasingly restricted as the engine is progressively increasingly throttled. A purge regulator that is under the control of the engine ECU also exercises control over the vapor flow to the induction system. The ECU is programmed using conventional programming techniques to produce a desired degree of purge flow regulation in accordance with engine operating conditions detected by the ECU. Thus, certain principles of the invention contemplate the conjoint control of the vapor flow from the canister to the induction system by the throttle's control of the variable orifice and by the ECU's control of the purge regulator.

A modern internal combustion engine that contains an ECU typically has a throttle position sensor that provides to the ECU an indication of the instantaneous throttle position. By having the variable orifice directly controlled by the throttle, the throttle position sensor signal is made inherently representative of the degree of restriction imposed by the variable orifice on vapor flow from the canister to the induction passage. Thus, the ECU can "read" the variable orifice and take that reading into account as it exercises control over the purge regulator.

The invention is well suited for providing controlled canister purging over a large dynamic range extending from engine idle to wide open throttle. It is also capable of providing a steadier flow that is beneficial in attenuating hydrocarbon emission spikes in the engine exhaust.

The remaining drawing figures relate to a novel construction for coupling the purge valve with the movable wall (diaphragm) that operates it. A rod that is guided for linear motion has one end connected to the movable wall and the other end to the purge valve. The connection to the movable wall is through a joint that essentially precludes the transmission of any bending moment from the movable wall to the rod. The connection to the valve provides for a certain wobble of the valve head that is advantageous for proper seating on the valve seat while preventing fluid leakage through the connection. The combination of these features enhances the accuracy of response of the device to commands.

The foregoing features, advantages, and benefits of the invention, along with additional ones, will be seen in the ensuing description and claims, which should be considered in conjunction with the accompanying drawings. The drawings disclose a presently preferred embodiment of the invention in accordance with the best mode contemplated at this time in carrying out the invention.

BRIEF DESCRIPTION OF THE DRAWINGS

FIG. 2 is a view looking in the direction of arrows 2—2 in FIG. 1.

FIG. 3 is a view similar to FIG. 2, but illustrating another position of operation.

FIG. 4 is a graph plot of actual test flow data useful in explaining certain principles of the invention.

DESCRIPTION OF THE PREFERRED EMBODIMENT

Figure 1:
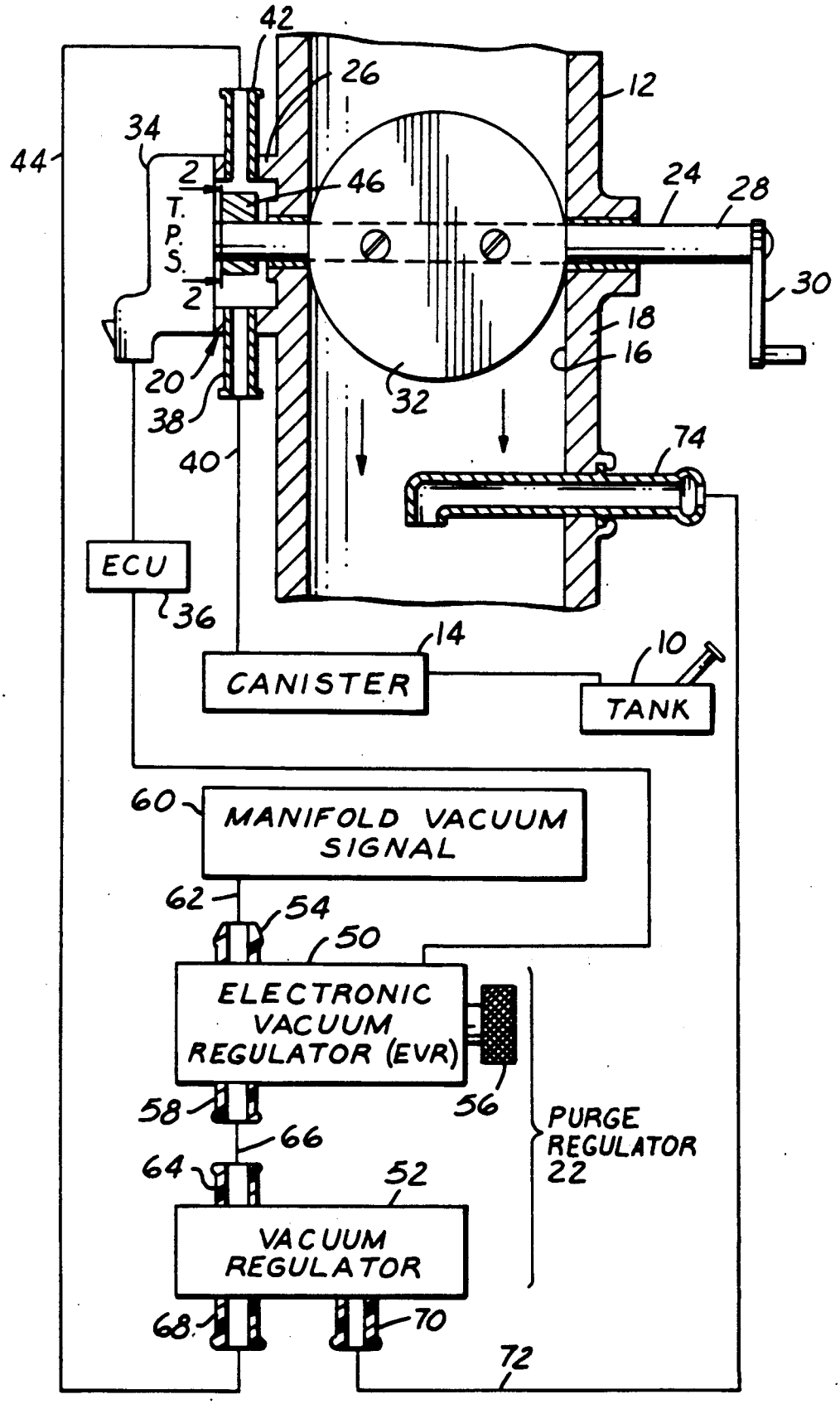
FIG. 1 is a schematic diagram presenting the presently preferred embodiment of regulated flow canister purge system according to the present invention.

An automotive vehicle that is powered by an internal combustion engine includes a fuel tank 10 and a throttle assembly 12. Excess fuel vapors that are vented from tank 10 are collected in a canister 14. The collected vapors are exhausted from canister 14 to the air induction passage 16 that passes through the body 18 of throttle assembly 12 with the passage of the vapors being under the conjoint control of a variable orifice valve 20 and a purge regulator 22.

Variable orifice valve 20 is operated directly by the throttle mechanism 24 of throttle assembly 12. Valve 20 comprises a body 26 that is fixedly mounted on the outside wall of throttle body 18.

Throttle mechanism 24 comprises a shaft 28 that is arranged perpendicular to the direction of induction air flow through passage 16 and is journaled for rotation on the throttle body. Shaft 28 is operated by a crank 30 that is linked to the vehicle accelerator pedal (not shown). A throttle blade, or butterfly, 32 is fastened to shaft 28 within passage 16. The extent to which shaft 28 is operated by crank 30 determines the position of butterfly 32 within passage 16 and hence the degree of throttling of the engine.

The end of shaft 28 opposite crank 30 passes through body 26 to operate a throttle position sensor (TPS) 34 that is disposed outboard of variable orifice valve 20. TPS 34 is one of a number of inputs to an engine electronic control unit (ECU) 36, the other inputs to the ECU not appearing in FIG. 1. TPS 34 provides to ECU 36 an electrical signal indicative of the instantaneous throttle position.

ECU 36 controls a number of engine operating functions, such as fuel, spark, etc. It also exercises control over purge regulator 22.

Details of variable orifice valve 20 include an inlet nipple 38 providing for the connection of a hose 40 from canister 14 and an outlet nipple 42 providing for connection of a hose 44 to purge regulator 22. Disposed within the interior of valve body 26 and affixed to shaft 28 is a valving member in the form of a rotary cam 46.

As shown in FIGS. 2 and 3, cam 46 has a profile 48 that is adapted to coact with the interior end of nipple 42 as the throttle shaft rotates thereby providing a variable restriction. FIG. 1 shows throttle blade 32 in essentially the wide open throttle position, and the corresponding position portrayed by FIG. 2 represents the minimum restriction position of the variable orifice valve.

As the throttle is progressively operated from the wide open throttle position toward engine idle position, cam 46 rotates in the clockwise sense as viewed in FIG. 2 to progressively increasingly restrict the variable orifice. At engine idle, as represented by FIG. 3, the variable orifice imposes maximum restriction to flow from canister 14. Since TPS 34 is being concurrently operated with cam 46, the TPS signal to ECU 36 is inherently representative of the degree of restriction being imposed by the variable orifice valve on vapor flow from the canister. In this way, the ECU can "read" the TPS to determine the restriction being imposed on the flow from the canister.

Purge regulator 22 may be considered to comprise two conventional components, namely an electronic vacuum regulator (EVR) 50 and a vacuum regulator 52. A device like that described in commonly assigned U.S. Pat. No. 4,850,384 is suitable for EVR 50. The EVR has a vacuum inlet nipple 54, an atmospheric vent 56, and a vacuum outlet nipple 58. Nipple 54 is connected to a vacuum signal source, namely engine manifold vacuum 60, by a hose 62. The EVR contains a solenoid that is pulse width modulated by ECU 36. In this way the vacuum level that appears at nipple 58 is controlled by ECU 36.

Vacuum regulator 52 comprises a control nipple 64 that is connected to nipple 58 by a hose 66. It also has an inlet nipple 68 to which hose 44 is connected and an outlet nipple 70 connected by a hose 72 to a nipple 74 that extends through the wall of throttle body 18 at a location downstream of throttle blade 32. Vacuum regulator 52 is responsive to the vacuum output of EVR 50 to regulate the flow through the vacuum regulator from nipple 68 to nipple 70. The larger the vacuum delivered to nipple 64, the more flow is permitted from nipple 68 to nipple 70, and the smaller the vacuum delivered to nipple 64, the less flow is permitted from nipple 68 to nipple 70. And so it can be appreciated that the vapor flow that is permitted by purge regulator 22 is under the control of ECU 36.

Accordingly, it can be further appreciated that the vapor flow from canister 14 to induction passage 16 is a function both of the throttle position as the throttle shaft controls variable orifice valve 20, and of the degree to which ECU 36 permits flow through purge regulator 22.

The effect of variable orifice valve 20 on the canister purge process can be nicely explained with reference to FIG. 4. For a given pressure drop across the valve, there exists a corresponding graph plot that charts the flow rate through the valve as a function of throttle blade position. FIG. 4 presents, by way of example, a series of six individual graph plots, each of which corresponds to a specific pressure drop across the variable orifice valve 20. The pressure drops that are represented in FIG. 4 are, in terms of inches of water, 0.5 inch, 1.0 inch, 1.5 inches, 2.0 inches, 3.0 inches, 4.0 inches. For a given pressure drop, the corresponding graph plot depicts the flow rate through the variable orifice valve 20 as a function of the amount of throttle blade opening between fully open and closed throttle conditions. Stated another way, for a given throttle position, the flow vs. pressure drop characteristic is defined for valve 20. Because the throttle position sensor provides the ECU with the capability of reading the variable orifice, suitable mapping of the ECU such as in the exemplary manner of FIG. 4 enables the ECU to know the corresponding flow vs. pressure drop characteristic of variable orifice valve 20 for specific throttle blade positions. The ECU can then take this into account when setting purge regulator 22.

The provision of the variable orifice valve 20 under the control of the throttle endows the emission control system with a wide dynamic range, allowing good control from engine idle to wide open throttle. As a result, the system can achieve compliance with stricter evaporative emission standards. The solenoid of EVR 50 is operated by a frequency of signal from the ECU which is considerably higher than that used to control previously used CPS valves. (125–150 hz vs 10–20 hz, typically). This serves to attenuate hydrocarbon spikes in exhaust emission.

FIG 5–9 present details of a purge regulator 80. It comprises an EVR 82 and a vacuum regulator 84. Although the illustrated purge regulator embodies the EVR and the vacuum regulator in a single unit, they could be embodied as two separate devices with a suitable connection from the EVR to the vacuum regulator.

EVR 82 is essentially conventional, comprising a vacuum inlet 86 to which vacuum is supplied and an outlet 88 at which a percentage of the vacuum is delivered, as determined by an electrical control signal supplied to an electrical input 90. The vacuum from outlet 88 is supplied as an input to vacuum regulator 84.

Vacuum regulator 84 may be considered to comprise an actuator portion 92 and a valve portion 94. Actuator portion 92 comprises a movable interior wall 95 that divides two variable volume chamber spaces 96 and 98 whose respective volumes establish the position of movable wall 95. Regulated vacuum from outlet 88 is supplied to chamber space 96. Chamber space 98 is in communication with the fuel vapor storage canister via valve portion 94.

Figure 5:
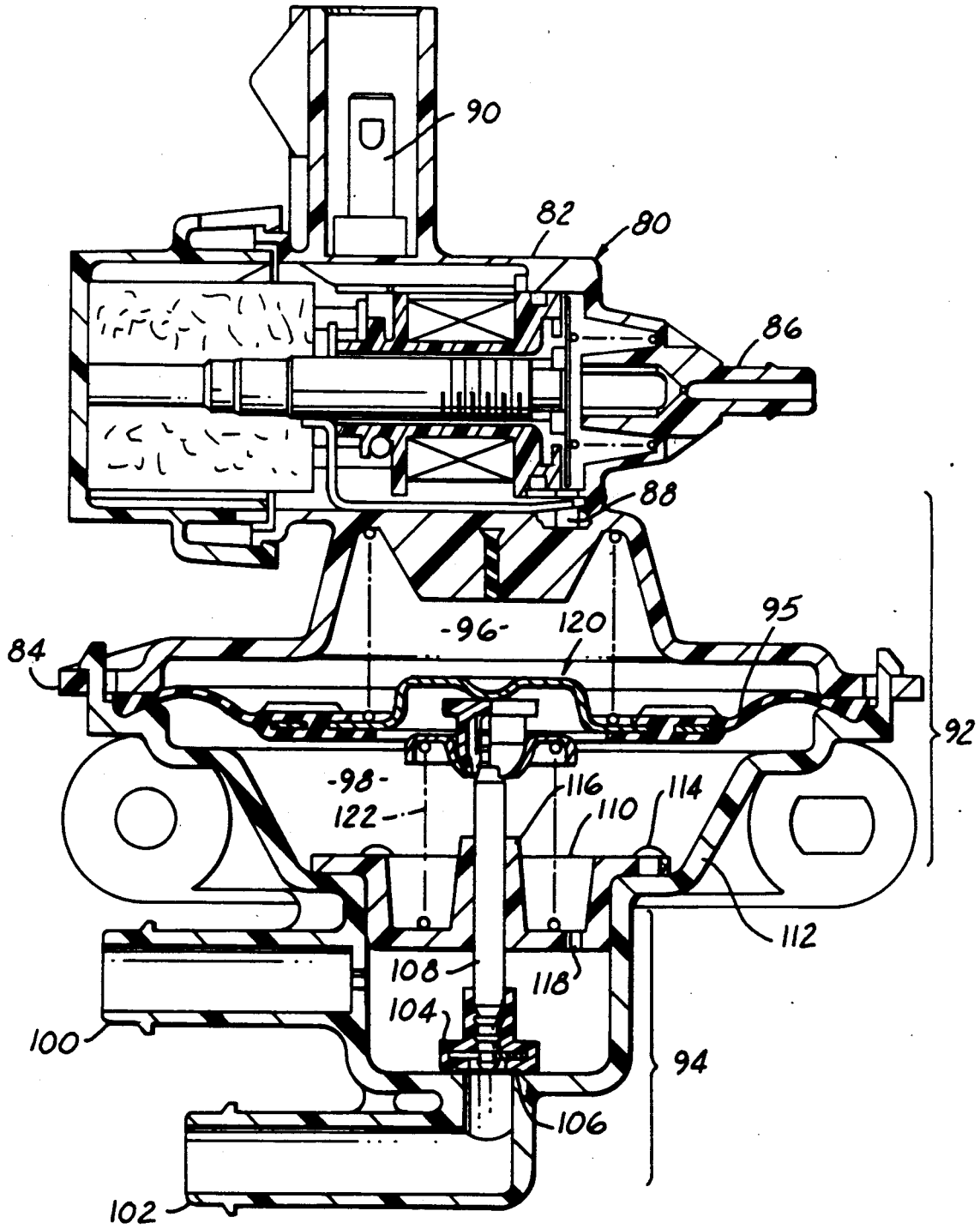
FIG. 5 is a cross section through a preferred embodiment of valve.
Figure 6:
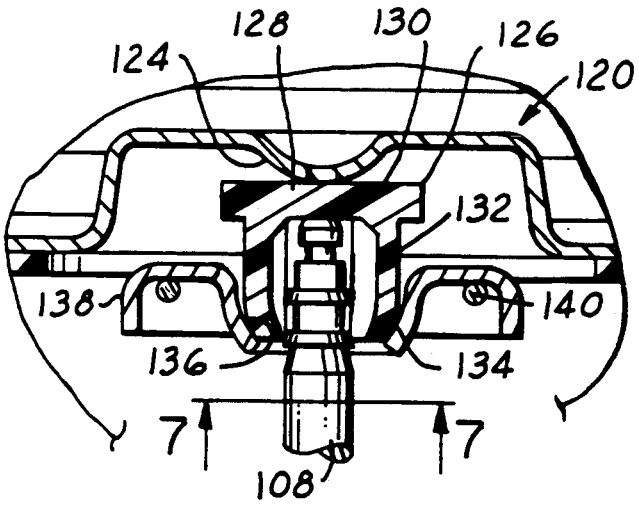
FIG. 6 is an enlarged fragmentary view of a portion of FIG. 5.
Figure 7:
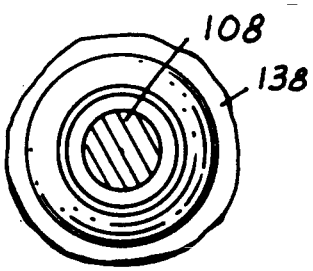
FIG. 7 is a transverse cross section taken in the direction of arrows 7—7 in FIG. 6.
Figure 8:
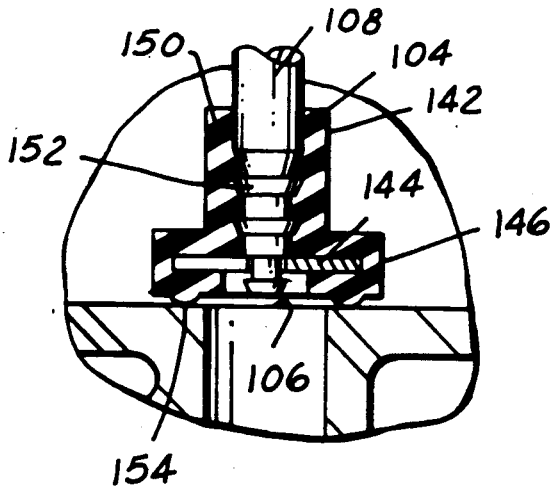
FIG. 8 is an enlarged fragmentary view of a portion of FIG. 5.

Valve portion 94 comprises an inlet nipple 100 via which it is placed in communication with the fuel vapor storage canister, and an outlet nipple 102 via which it is placed in communication with the engine intake manifold. A valve 104 that is operated by actuator portion 92 controls communication through valve portion 94 between inlet nipple 100 and outlet nipple 102. FIGS. 5 and 8 show valve 104 in seated position on a valve seat 106 preventing flow from nipple 100 to nipple 102.

Valve 104 is coupled to movable wall 95 by means that includes a straight circular cylindrical rod 108. Rod 108 is guided for straight-line motion toward and away from valve seat 106 by means of an annular guide member 110 which is secured to the housing 112 by any suitable means such as 114. Guide member 110 comprises a cylindrical sleeve 116 which is co-axial with both movable wall 94 and valve seat 106 and through which the central portion of rod 108 passes. Guide member 110 also comprises a hole 118 which serves to communicate chamber space 98 with whatever pressure or vacuum may occur on the canister side of valve 104.

The end of rod 108 that is opposite the end containing valve 104 is coupled with movable wall 95 by means of a joint 120 that is designed so as to be incapable of transmitting any significant bending moment from movable wall 95, through the rod, to the valve. This attribute is important because the action of movable wall 95 on the rod might otherwise impart a bending moment which could adversely affect rod displacement and hence impair the accuracy of the rod's positioning of valve 104. A principal cause of the tendency of movable wall 95 to impart a bending moment to rod 108 is due to the fact that the wall is resiliently biased by a helical coil spring 122 in a sense that urges valve 104 toward seating on seat 106, and the force distribution acting on the movable wall is not circumferentially uniform. Hence, the movable wall has a tendency to tilt, or cock about its axis, but adverse consequences of this tendency are avoided because of the provision of joint 120.

Joint 120 comprises a spherically contoured surface 124 in movable wall 95 acting through an element 126 on the end of rod 108. Element 126 comprises a head 128 having on one side a flat surface 130 against which surface 124 is in tangential contact. A cylindrical annular shank 132 extends from the opposite side of head 128 and is united to the rod end by an interference-fit therewith. The distal end of shank 132 is rounded at 134 for seating in a complementary rounded depression 136 in an annular member 138. The outer margin of member 138 is shaped to form a seat for one end of a further helical coil spring 140 that is disposed between member 138 and member 110, the latter having a spring seat for the opposite end of the spring. Spring 140 functions to keep the surface 130 of head 128 against surface 124 (i.e., capture element 126 between wall 95 and member 138) as the movable wall is positioned within the housing 112. The rounded fitting of member 138 to the distal end of shank 132 prevents spring 140 from transmitting any significant bending moment to the joint.

Figure 9:
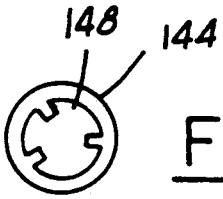
FIG. 9 is a plan view of one of the parts of FIG. 8 shown by itself.

FIGS. 5, 8, and 9 present details of valve 104 and its attachment to rod 108. Valve 104 comprises an elastomeric part 142 and a relatively more rigid metal part 144. Part 144 is a circular metal disc that is disposed interiorly of an annular head 146 of elastomeric part 142. Part 144 has an aperture 148 of the shape illustrated in FIG. 9 that provides for attachment of the part to rod 108 in such a manner that it can wobble to a certain extent on the rod. Part 142 further comprises an annular sleeve 150 extending from head 146 and seals the valve to the rod. The rod end is shown to have axially spaced circular serrations 152 that aid in the sealing and retention of the head on the rod end. Head 146 also contains a circular ridge 154 for sealing contact with valve seat 106. The design of valve 104 is beneficial in attaining proper sealing, especially in mass production usage, because the head can self-adjust to the seat while sealing of the valve to the rod end is assured.

The device operates in the following manner. Movable wall 95 is axially positioned in accordance with the pressure differential between the two chamber spaces 96, 98. Since a controlled percentage of manifold vacuum is applied to chamber space 96, the relative volumes of the two chamber spaces and hence the position of wall 95 are related to the percentage manifold vacuum applied to the vacuum regulator from the EVR. This will produce a corresponding positioning of valve 104 to control the flow of vapor from the canister to the manifold. In this way the purging of the canister is regulated to occur during conditions of engine operation that are conducive to purging.

The invention can therefore be seen to constitute an improvement in evaporative emission control systems. While a presently preferred embodiment of the invention has been illustrated and described, it will be appreciated that principles are applicable to other equivalent embodiments within the scope of the following claims.

What is claimed is:

1. For controlling the purging of a fuel vapor collection canister of an evaporative emission control system associated with the fuel system of an internal combustion engine, a regulated flow canister purge arrangement comprising an electronic vacuum regulator having a vacuum inlet at which engine manifold vacuum is received, an outlet at which is delivered a percentage of the engine manifold vacuum received at the vacuum inlet as determined by an electronic control signal supplied to a control input of the electronic vacuum regulator, a canister purge inlet to which a canister that is to be purged of gaseous fuel vapors is communicated, a canister purge outlet that is communicated to engine manifold vacuum, valve means for controlling flow between said canister purge inlet and said canister purge outlet, and a movable wall for operating said valve means, one side of said movable wall bounding one variable volume chamber and another side of said movable wall bounding another variable volume chamber, a helical coil spring disposed in said one variable volume chamber and acting on said movable wall so as to cause said valve means to be biased toward blocking flow between said canister purge inlet and said canister purge outlet, means communicating the outlet of said electronic vacuum regulator with said one variable volume chamber to cause the volumes of said chambers to vary in relation to the percentage of manifold vacuum applied to said one variable volume chamber, and a coupling mechanism between said movable wall and said valve means, characterized in that said coupling mechanism comprises a straight rod that is guided by a guide means disposed in said another variable volume chamber for essentially straight linear displacement, and a joint between said rod and said movable wall that substantially precludes the transmission of a bending moment from said movable wall, through said rod, to said valve means, and further characterized in that said joint comprises a spherically contoured surface on said movable wall disposed tangentially against a flat surface portion of an element that is disposed on an end of said rod.

2. An arrangement as set forth in claim 1 in which said element comprises a head one side of which contains said flat surface and another side of which contains a cylindrical-walled shank extending from said head, said cylindrical-walled shank having a rounded distal end that seats on a rounded portion of an annular member through which said rod passes to provide for said one end of said rod to fit into said cylindrical-walled shank and which is resiliently biased by a further helical coil spring against said element in a direction opposite the direction in which the first-mentioned helical coil spring acts on said movable wall, whereby said element is captured between said annular member and said movable wall.

3. An arrangement as set forth in claim 2 in which said guide comprises an annular guide member having both a guide sleeve embracing said rod at a location between the rod's ends for axially guiding said rod as it operates said valve means and a spring seat for seating an end of said further helical coil spring.

4. An arrangement as set forth in claim 3 in which said annular guide member also comprises means to communicate said another variable volume chamber with the side of said valve that is toward said canister purge inlet.

5. An arrangement as set forth in claim 3 in which said valve means comprises an elastomeric valve element having an annular head and a relatively more rigid disc that is disposed interiorly of said head and comprises an aperture that provides an attachment of said disc to said rod that allows said disc to wobble on said rod, said elastomeric valve element also having a sleeve that extends from said head and seals said elastomeric valve element to said rod.

6. For controlling the purging of a fuel vapor collection canister of an evaporative emission control system associated with the fuel system of an internal combustion engine, a regulated flow canister purge arrangement comprising an electronic vacuum regulator having a vacuum inlet at which engine manifold vacuum is received, an outlet at which is delivered a percentage of the engine manifold vacuum received at the vacuum inlet as determined by an electronic control signal supplied to a control input of the electronic vacuum regulator, a canister purge inlet to which a canister that is to be purged of gaseous fuel vapors is communicated, a canister purge outlet that is communicated to engine manifold vacuum, valve means for controlling flow between said canister purge inlet and said canister purge outlet, and a movable wall for operating said valve means, one side of said movable wall bounding one variable volume chamber and another side of said movable wall bounding another variable volume chamber, biasing means acting on said movable wall so as to cause said valve means to be biased toward blocking flow between said canister purge inlet and said canister purge outlet, means communicating the outlet of said electronic vacuum regulator with said one variable volume chamber to cause the volumes of said chambers to vary in relation to the percentage of manifold vacuum applied to said one variable volume chamber, and a coupling mechanism between said movable wall and said valve means, characterized in that said coupling mechanism comprises a straight rod that is executes essentially straight linear displacement in response to movement of said movable wall, and in which said valve means comprises an elastomeric valve element having an annular head and a relatively more rigid disc that is disposed interiorly of said head and comprises an aperture that provides an attachment of said disc to said rod that allows said disc to wobble on said rod, said elastomeric valve element also having a sleeve that extends from said head and seals said elastomeric valve element to said rod.

7. An arrangement as set forth in claim 6 in which a joint between said rod and said movable wall substantially precludes the transmission of a bending moment from said movable wall, through said rod, to said valve means.

8. An arrangement as set forth in claim 7 characterized in that said joint comprises a spherically contoured surface on said movable wall disposed tangentially against a flat surface portion of an element that is disposed on an end of said rod.

9. An arrangement as set forth in claim 8 in which said another variable volume chamber contains an annular guide member having a guide sleeve embracing said rod at a location between the rod's ends for axially guiding said rod as it operates said valve means.

10. An arrangement as set forth in claim 9 in which said annular guide member also comprises means to communicate said another variable volume chamber with the side of said valve means that is toward said canister purge inlet.

* * * * *